US005377434A

United States Patent [19]

Wilson

[11] Patent Number: 5,377,434

[45] Date of Patent: Jan. 3, 1995

[54] SECTIONAL FRAME DISPLAY

[76] Inventor: Arthur K. Wilson, 1050 McNicoll Avenue, Unit #12, Scarborough, Ontario, Canada, M1W 2L8

[21] Appl. No.: 143,096

[22] Filed: Oct. 29, 1993

[51] Int. Cl.[6] ..... G09F 7/02

[52] U.S. Cl. ..... 40/611; 40/5

[58] Field of Search ..... 40/152, 605, 611, 618, 40/624, 5; 49/464; 52/476, 477, 656

[56] References Cited

U.S. PATENT DOCUMENTS 2,948,976 8/1960 Miller, Jr. ..... 40/624
3,403,491 10/1968 Eichman ..... 52/476 X
3,783,543 1/1974 Hemgren ..... 40/152
3,817,396 6/1974 Markson ..... 40/605 X
4,166,332 9/1979 Donovan ..... 40/605
4,630,386 12/1986 Wilson ..... 40/155

*Primary Examiner*—Brian K. Green
*Attorney, Agent, or Firm*—Arne I. Fors

[57] ABSTRACT

A frame for one or two-sided display of several pictures simultaneously having a unique configuration and novel combination of component parts which includes a sub-frame within an outer frame to permit quick and permanent assembly and to provide a rigid frame structure for easy exchange and replacement of several pictures or posters is disclosed.

3 Claims, 6 Drawing Sheets

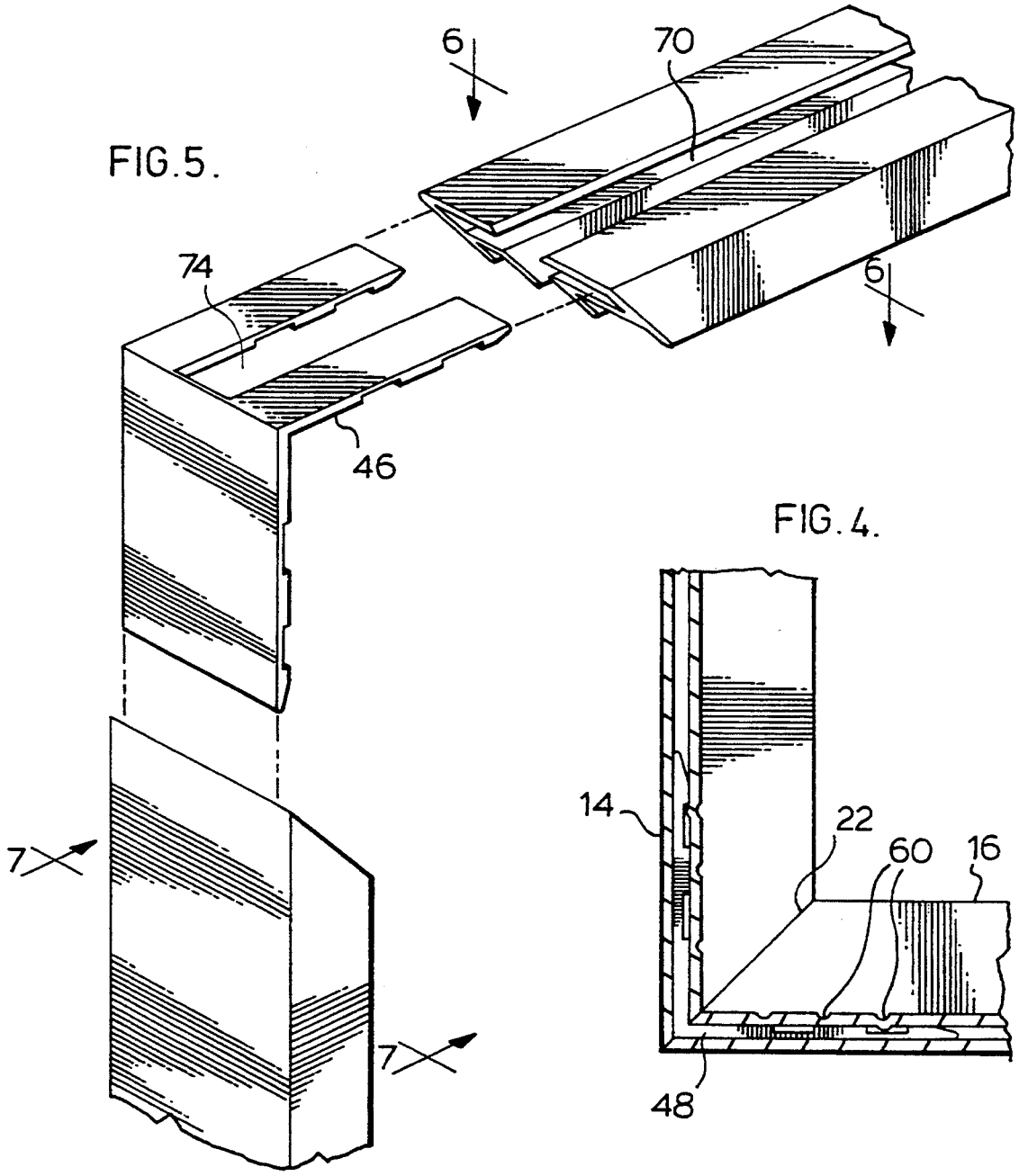
FIG. 5.
FIG. 4.
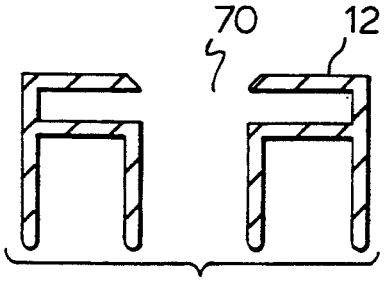
FIG. 6.
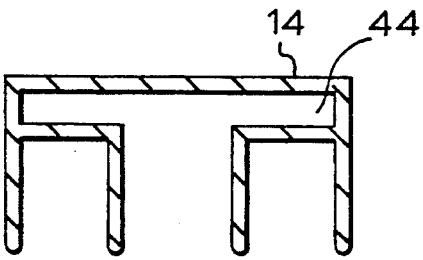
FIG. 7.

SECTIONAL FRAME DISPLAY

BACKGROUND OF THE INVENTION

This invention relates to a frame and, more particularly, relates to a frame assembly for one or two sided display of several pictures or posters where only one would have normally been displayed.

Conventional frames for pictures or posters are intended for display of a single poster only. A recess on the inner surface of the frame engages the perimeter of a poster to hold it in place. It is an object of the present invention to provide a sub-frame assembly in conjunction with a conventional outer frame to display several posters.

Pictures or posters displayed in a window or open space which may be viewed from both sides require a frame to facilitate two sided viewing. A further object of the present invention is the provision of a frame assembly which permits mounting pictures or posters to be viewed from both sides.

U.S. Pat. No. 3,783,543 discloses a knock down frame for exchangeable posters. Angle connectors for holding frame components together are secured by headless screws. However, bifurcated angle connectors having a slot to permit exchange of posters cannot be secured to the adjacent frame components and the frame, especially of a large commercial size, lacks desired rigidity.

U.S. Pat No. 4,630,386 discloses a one or two sided frame permitting quick and permanent assembly to rigidly display a single poster. Posters may be easily exchanged through a slot in one outer frame component.

SUMMARY OF THE INVENTION

The frame of the present invention for one or two sided display of several pictures or posters simultaneously, has a unique configuration and novel combination of component parts which includes a sub-frame within an outer frame to permit quick and permanent assembly and to provide a rigid frame structure for easy exchange and replacement of several pictures or posters.

The frame of the invention, in more detail, comprises in combination, four outer frame components, each outer frame component having an outer sidewall with parallel side edges, inwardly facing outer walls depending from said sidewall edges substantially parallel to each other and extending an equal distance inwardly defining a continuous longitudinal recess, said frame components attached to form a rigid rectangular frame, one of said outer frame components having a longitudinal slot formed substantially from one end to the other in the outer sidewall co-extensive with said recess for insertion and removal of a plurality of planar sheets therefrom, a plurality of "I" shaped dividers having a pair of substantially parallel flanges formed integral with and joined to opposing edges of a central web to define a pair of longitudinal recesses, at least one divider having one end adapted to fit the recess of one outer frame component positioned perpendicular thereto and having a length less than that of adjacent outer frame components, a plurality of substantially rigid planar sheets slightly longer than the perpendicular divider, adapted to fit between said perpendicular divider and said adjacent outer frame components and protrude slightly above said perpendicular divider, a transverse divider adapted to fit the protrusion of said planar sheet, having opposite ends adapted to fit in the recess of said adjacent outer frame components, and an elongated rigid sheet adapted to fit between said adjacent outer frame components and said transverse divider in the recess thereabout.

BRIEF DESCRIPTION OF THE DRAWINGS

The frame of the invention will now be described with reference to the accompanying drawings, in which:

FIG. 4 is a perspective view of the components shown in FIG. 3 after assembly;

FIG. 5 is an exploded perspective view of an upper corner of the outer frame of the invention;

FIG. 6 is a section taken along line 6—6 of FIG. 5;

FIG. 7 is a section taken along line 7—7 of FIG. 5;

DESCRIPTION OF THE PREFERRED EMBODIMENTS

With reference now to FIGS. 1–7 of the drawings, the outer frame of the present invention comprises four outer frame components 10, 12, 14 and 16 formed of extruded material such as plastic or aluminum alloy. The corners 20 of the outer frame have 45 degree miter joints 22 for assembly together of the components to form a substantially rectangular configuration.

Figure 2:
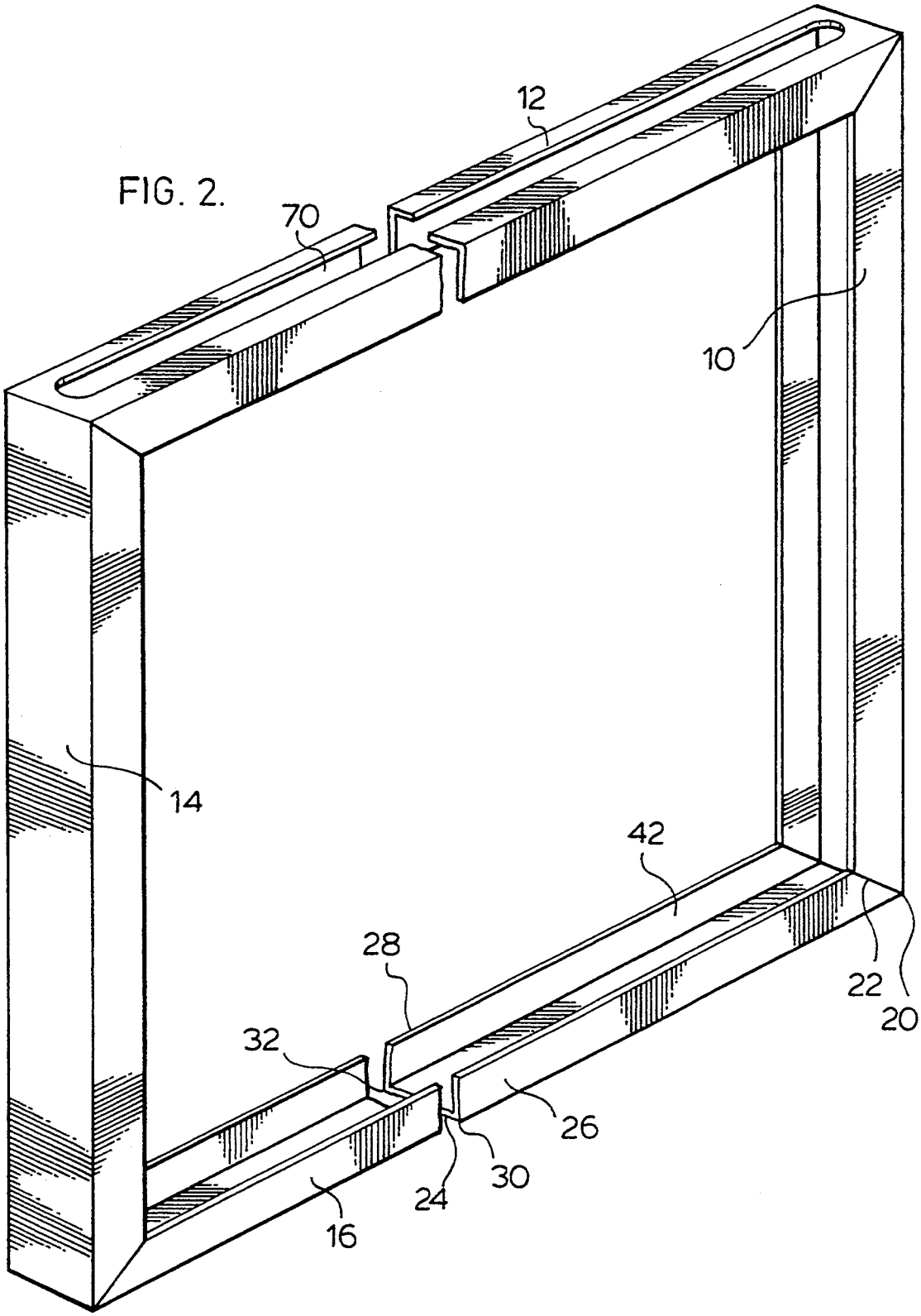
FIG. 2 is a perspective view of an embodiment of outer frame.

With reference to the embodiment of frame shown in FIG. 2, each of the outer frame components has an outer planar sidewall 24 with inwardly facing outer walls 26, 28 depending from the outer side wall edges 30, 32 substantially parallel to each other and extending an equal distance inwardly defining a continuous longitudinal recess 42 therebetween, extending to adjacent outer frame components.

One of the outer frame components 12 has a longitudinal slot 70 formed substantially from one end to the other in the outer planar side wall 24 co-extensive with said recess 42.

Figure 1:
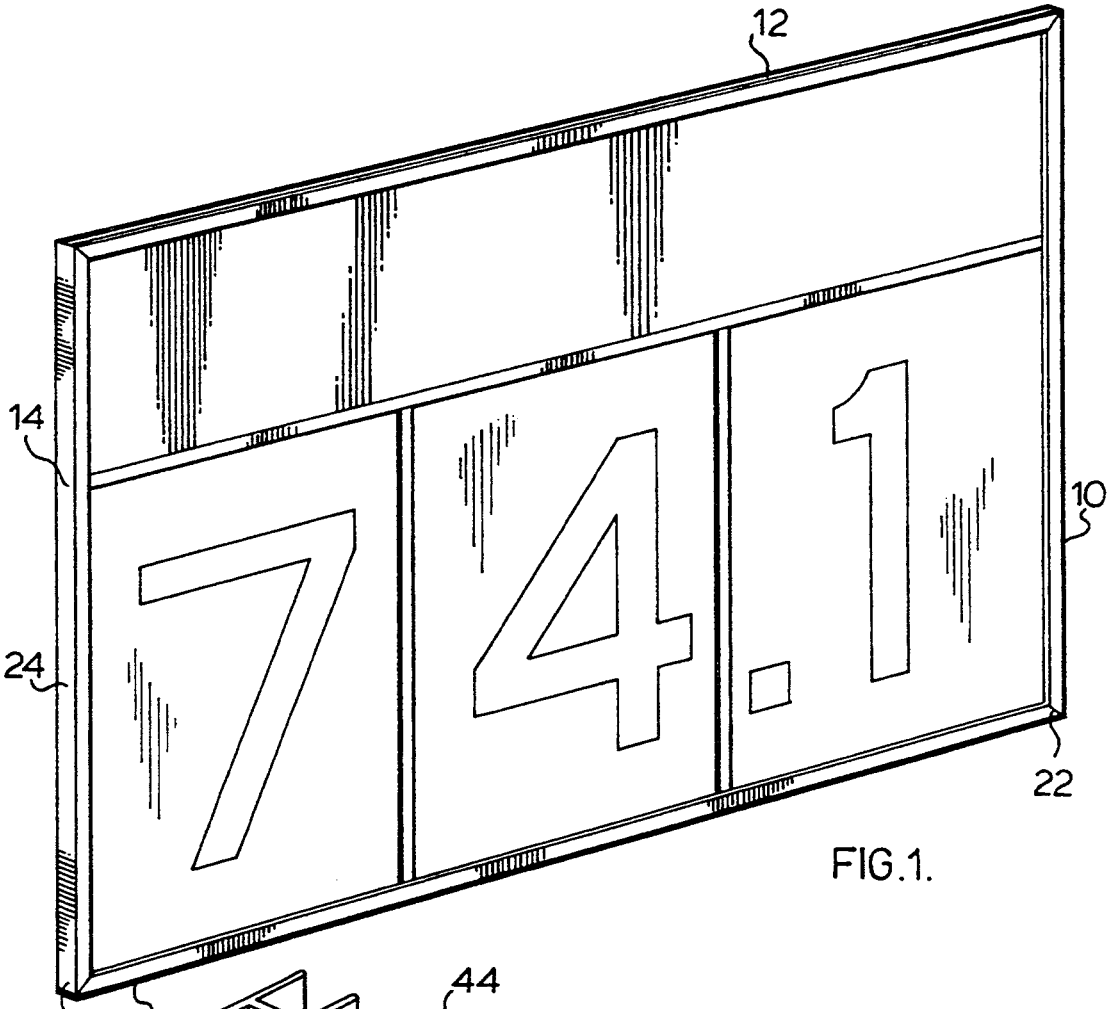
FIG. 1 is a perspective view of the frame of the present invention.
Figure 3:
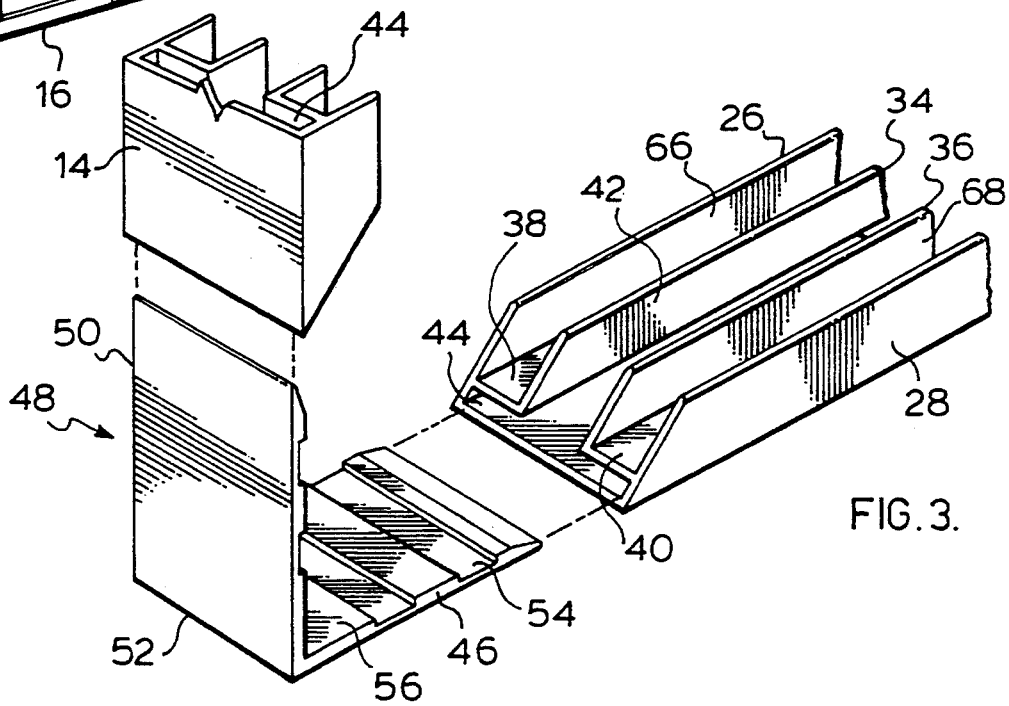
FIG. 3 is an exploded perspective view of lower corner of a preferred embodiment of outer frame of the invention showing outer frame components and corner bracket.

Referring now to FIG. 3, in a more preferred embodiment, a pair of equispaced inner walls 34, 36 are formed integral with and joined to walls 26, 28 respectively by transverse shoulders 38, 40 to define a continuous longitudinal recess 42 extending therebetween to outer side wall 24.

Shoulders 38, 40 are opposed to and equispaced from outer side wall 24 and define therebetween a recess 44 which is adapted to receive a leg 46 of corner connector 48 which has a pair of legs 46, 50 secured together at their juncture 52 and disposed at 90 degrees to each other. Leg 50 of corner connector 48 is adapted to be inserted into recess 44 of the adjacent member 14.

Each of connectors 48 has transverse recess 54 formed on the inner faces 56, of the legs to receive indentations 60, as shown most clearly in FIG. 4.

A punch readily permits forming of indents 60, in all outer frame components including upper component 12, due to presence of recesses 66, 68 formed between wall 26, 34 and 28, 36 respectively. To facilitate slot 70 in frame component 12, corner connector 46 has bifurcated slot 74 formed therein in alignment with inner slot as shown in FIG. 5.

The above is a conventional picture frame as shown in the prior art in accordance with my U.S. Pat. No. 4,630,386 incorporated herein by reference.

Figure 9:
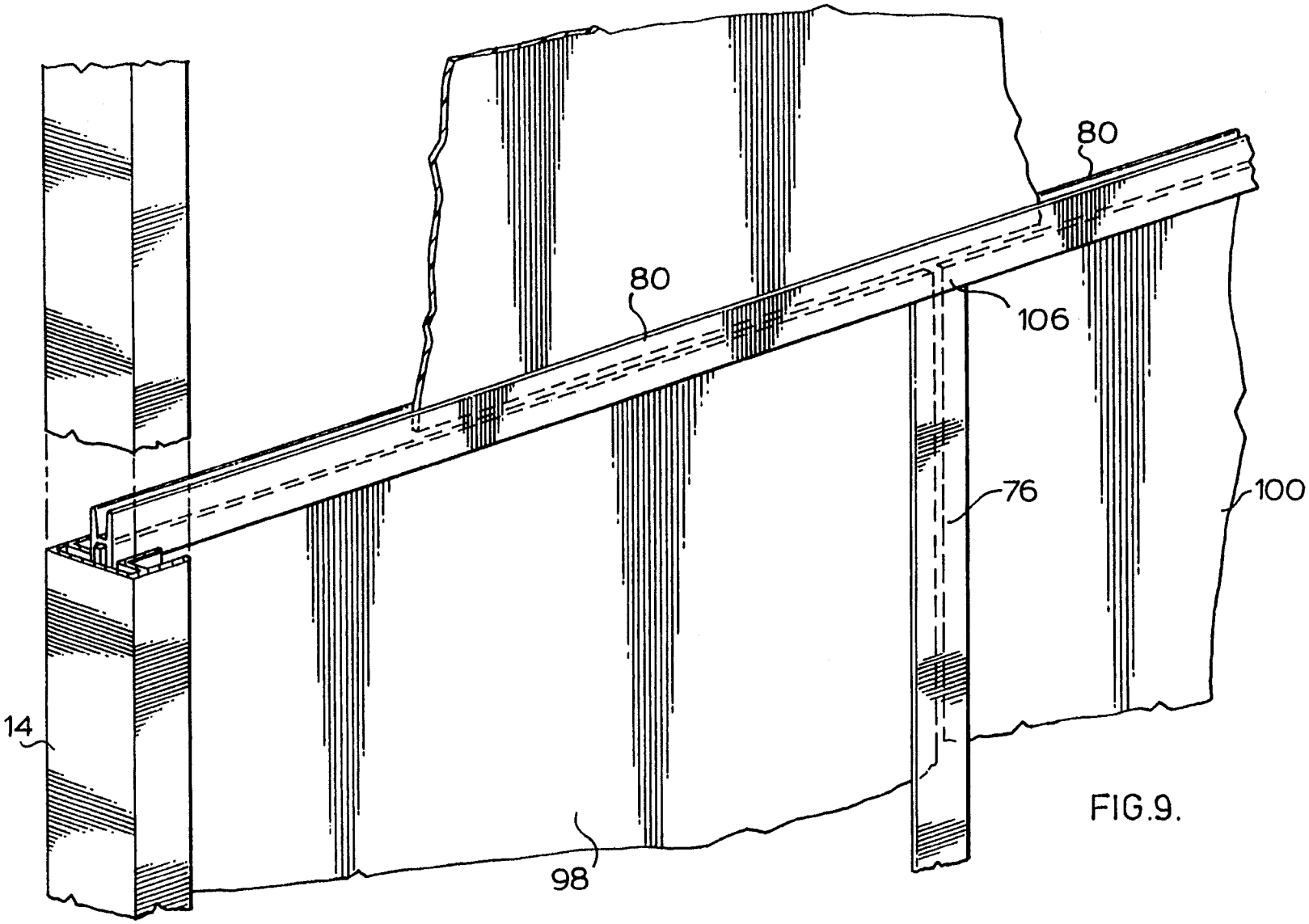
FIG. 9 is a perspective view partially cut away showing the central assembly thereof.

Now referring to FIGS. 7 and 9, inner frame dividers 76, 78 and 80 are formed from "I" shaped members having a pair of substantially parallel flanges 84, 86 formed integral with and joined to opposing edges of a central web 92 to define a pair of longitudinal recesses 94, 96 adjacent each face of said central web.

Figure 8:
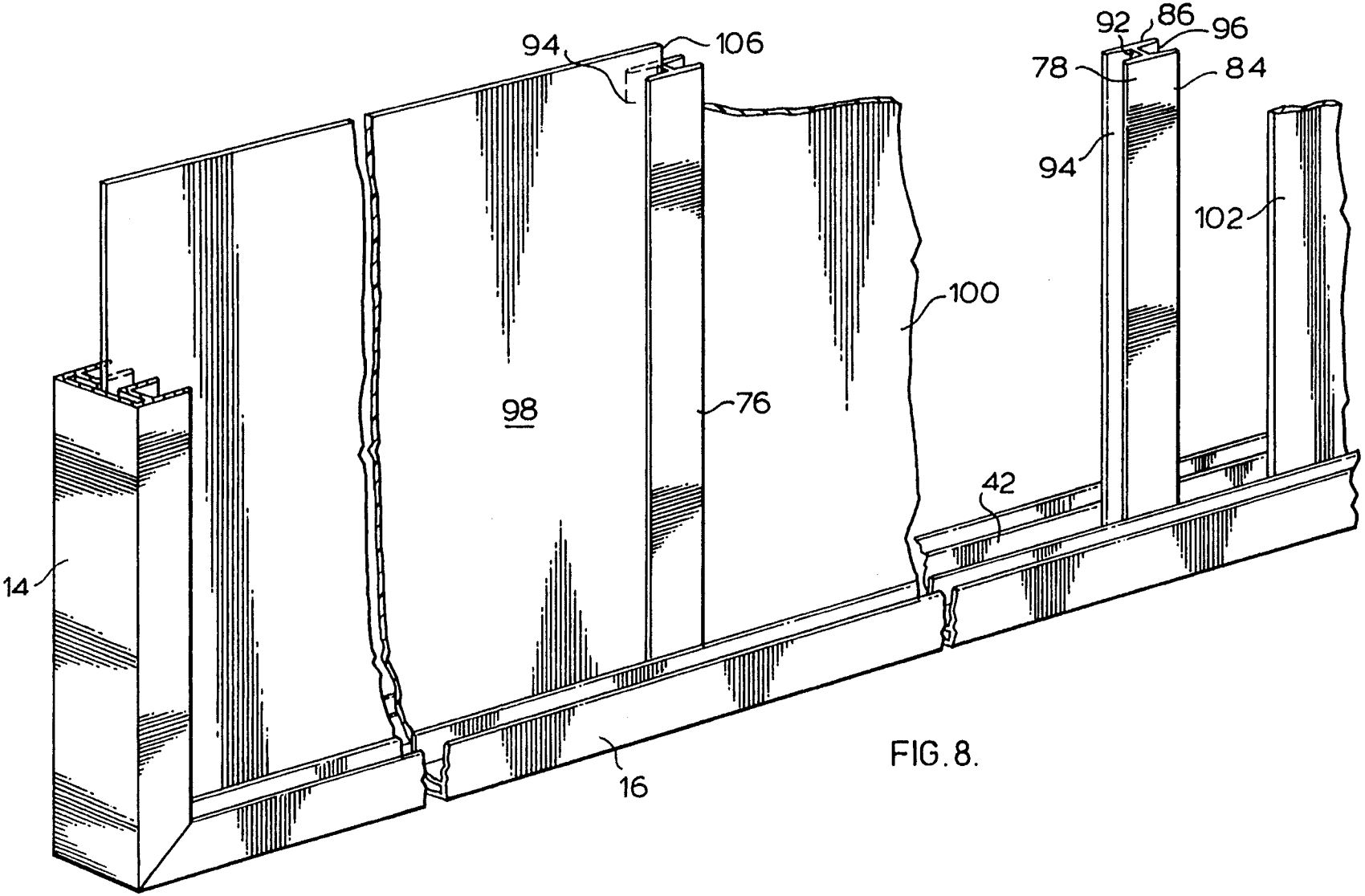
FIG. 8 is a perspective view partially cut away showing the lower assembly of an embodiment of the frame of the invention.
Figure 10:
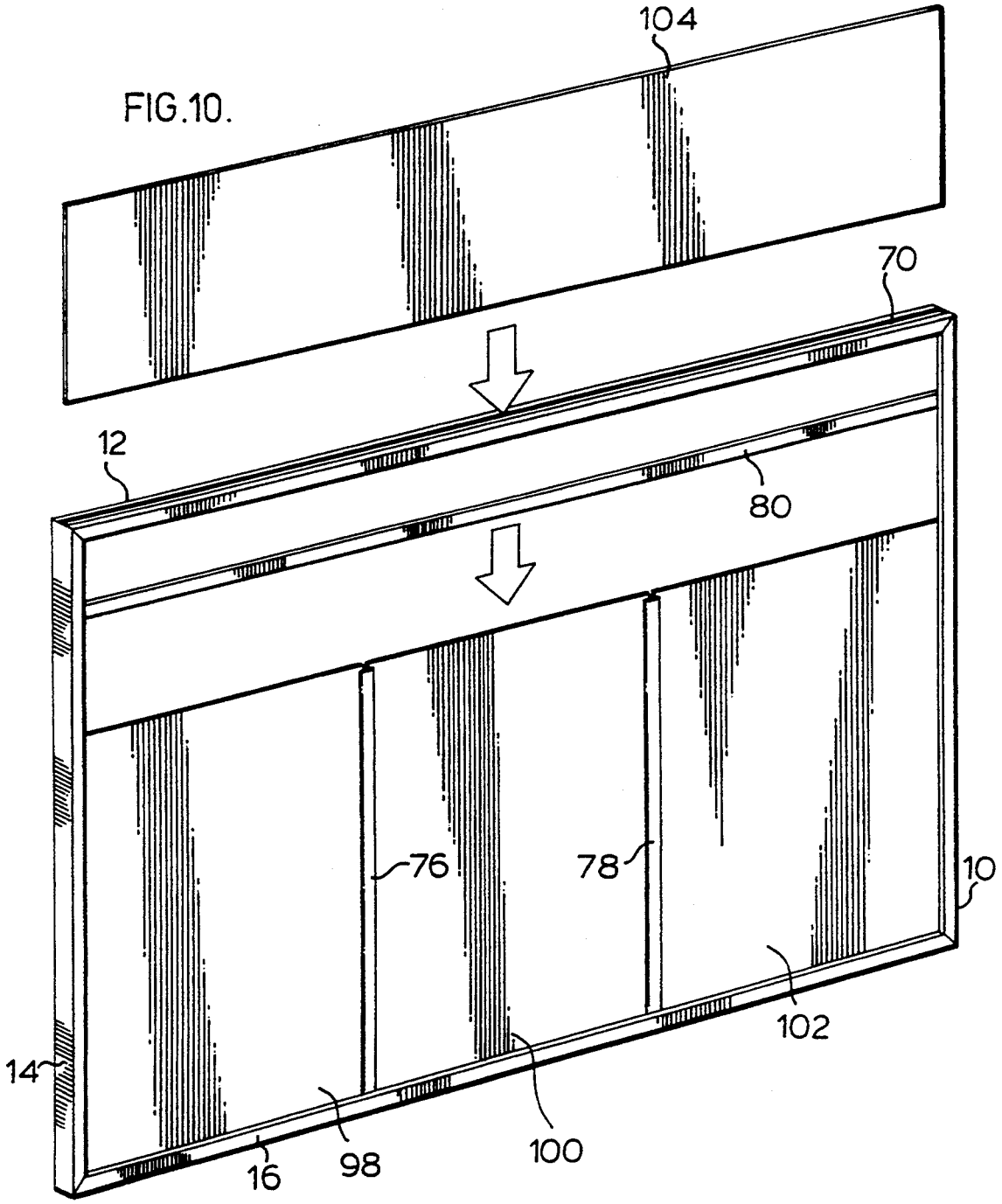
FIG. 10 is a partially exploded perspective view of the invention prior to final assembly.

Referring to FIGS. 8 and 10, vertical dividers 76, 78 are fitted perpendicularly into the recess 42 of the outer lower frame component 16, said dividers having an equal length which is less than that of adjoining outer vertical frame components 10 and 14.

Planar sheets 98, 100 and 102 fitted between dividers 76, 78 and outer frame components 10, 14 have side and bottom edges adapted to fit into the adjacent recesses. Each sheet has a height slightly higher than that of said dividers to provide a slight protrusion 106 above the upper ends of dividers 76, 78.

With reference to FIGS. 9 and 10, a transverse divider 80 formed from an "I" shaped member and extending between outer frame components 10, 14 is fitted into recesses of said outer frame components and onto the protrusion 106 of the planar sheets 98, 100 and 102.

An elongated planar sheet 104 is fitted in the recess above the transverse divider 60 via the slot 70 in the outer frame component 12.

The structure of the present invention provides a number of important advantages. Several pictures or posters of various sizes may be displayed at the same time on a single outer frame and may be viewed from one or both sides.

A simple embodiment of my invention employs a basic "U" channel for the outer frame while a more preferred embodiment uses a more elaborate extrusion to provide greater rigidity and ease of assembly.

It will be understood, of course, that modifications can be made in the embodiment of the invention illustrated and described herein without departing from the scope and purview of the invention as defined in the appended claims.

What I claim as new and desire to protect by Letters Patent of the United States is:

1. A frame for two-sided or single-sided display and exchange of a plurality of pictures and posters comprising, in combination, four outer frame components, each outer frame component having an outer sidewall with parallel side edges, inwardly facing outer walls depending from said sidewall edges substantially parallel to each other and extending an equal distance inwardly defining a continuous longitudinal recess, said frame components attached to form a rigid rectangular frame, one of said outer frame components having a longitudinal slot formed substantially from one end to the other in the outer sidewall co-extensive with said recess for insertion and removal of a plurality of planar sheets therefrom, a plurality of "I" shaped dividers having a pair of substantially parallel flanges formed integral with and joined to opposing edges of a central web to define a pair of longitudinal recesses, at least one divider having one end adapted to fit the recess of one outer frame component positioned perpendicular thereto and having a length less than that of adjacent outer frame components, a plurality of substantially rigid planar sheets slightly longer than the perpendicular divider, adapted to fit between said perpendicular divider and said adjacent outer frame components and protrude slightly above said perpendicular divider to form a protrusion, a transverse divider adapted to fit the protrusion of said planar sheets, having opposite ends adapted to fit in the recess of said adjacent outer frame components, and an elongated rigid sheet adapted to fit between said adjacent outer frame components and said transverse divider in the recess thereabout.

2. A frame as claimed in claim 1 in which each of said outer frame components has an outer planar sidewall with parallel side edges, inwardly facing outer walls depending from said side wall edges substantially parallel to each other, a pair of equispaced inner walls positioned within said inwardly facing outer walls formed integral with and joined to the adjacent inwardly facing outer wall and spaced therefrom by a pair of shoulders at their respective bases to define a longitudinal recess adjacent each outer wall to define a longitudinal slot between the inner walls extending to the opposed outer side walls, each pair of said shoulders and opposed outer side wall together defining a transverse channel, and a corner connector for insertion into the channels of adjacent frame components whereby the shoulders can be indented to frictionally engage the corner connector to form a rigid rectangular frame.

3. A frame as claimed in claim 2 in which each of said corner connectors comprises a bracket having a pair of legs disposed at 90 degrees to each other, said legs each having transverse recesses formed on inner faces thereof for receiving indents formed in the outer frame components.

* * * * *